United States Patent [19]

Gueret

[11] Patent Number: 4,974,980

[45] Date of Patent: Dec. 4, 1990

[54] RESERVOIR AND AN APPLICATOR WITH A FLEXIBLE FRUSTOCONICAL, CYLINDRICAL DISTRIBUTOR TIP

[75] Inventor: Jean-Louis Gueret, Paris, France

[73] Assignee: L'Oreal, Paris, France

[21] Appl. No.: 363,042

[22] Filed: Jun. 6, 1989

[30] Foreign Application Priority Data

Jun. 23, 1988 [FR] France ..... 88 08441

[51] Int. Cl.[5] ..... A45D 40/26

[52] U.S. Cl. ..... 401/119; 401/126; 401/128; 401/129

[58] Field of Search ..... 401/119, 126, 129, 122, 401/128

[56] References Cited

U.S. PATENT DOCUMENTS

| | | | |
|---|---|---|---|
| 1,966,581 | 7/1934 | Conner | 401/128 |
| 2,029,835 | 2/1936 | Reichle | 401/119 X |
| 2,210,766 | 8/1940 | McGinnis et al. | 401/128 |
| 2,509,369 | 5/1950 | Robertson | 401/122 |
| 2,681,463 | 6/1954 | Gordon | 401/128 |
| 2,990,563 | 7/1961 | Davidson | 401/128 X |
| 4,404,977 | 9/1983 | Vasas | 401/129 X |
| 4,437,477 | 3/1984 | Gueret | 401/122 X |
| 4,503,872 | 3/1985 | Gueret | 401/122 |
| 4,635,659 | 1/1987 | Spatz | 401/129 X |
| 4,796,647 | 1/1989 | Gueret | 401/122 X |

FOREIGN PATENT DOCUMENTS

| | | |
|---|---|---|
| 8530701 | 2/1986 | Fed. Rep. of Germany . |
| 2500730 | 2/1981 | France . |
| 2505150 | 3/1981 | France . |
| 2486375 | 1/1982 | France . |
| 2412287 | 12/1987 | France . |
| 2603780 | 3/1988 | France . |

*Primary Examiner*—Steven A. Bratlie

*Attorney, Agent, or Firm*—Cushman, Darby & Cushman

[57] ABSTRACT

The invention relates to an assembly including a reservoir that contains a liquid and an applicator equipped with a flexible, elastically deformable pen (3); the pen has the shape of a truncated cone (31), elongated at its end of smaller diameter by a cylindrical portion (32) having the same smaller diameter. The pen may be flocked and may include a cavity (35) through it from one side to the other and opening into the bottom of a capillary groove (34). The invention is usable for applying any liquid makeup product, and in particular for applying eyeliner to the eyelids.

14 Claims, 1 Drawing Sheet

RESERVOIR AND AN APPLICATOR WITH A FLEXIBLE FRUSTOCONICAL, CYLINDRICAL DISTRIBUTOR TIP

FIELD OF THE INVENTION

The present invention relates to an assembly including a reservoir containing a liquid, and an applicator equipped with a flexible, elastically deformable distributor tip enabling the application of the product contained in the reservoir to a surface.

BACKGROUND OF THE INVENTION

This assembly can be used for any liquid makeup product, such as blusher, or coverup for circles under the eyes, and more particularly for applying eyeliner to the eyelids. It may also be used to apply stain remover to a fabric, and is generally usable for applying any product or reactive liquid to a surface. For use, the distributor tip of the applicator is dipped into the reservoir, and then the flexible tip is used to deposit the product from the reservoir onto the surface to be made up.

The present invention relates, for the sake of simplicity, to makeup products, but the full scope of the present invention is in no way limited to such use. The flexible distributor tip will be referred to herein as a pen, because of the fineness of the lines of makeup that can be obtained with it.

In makeup assemblies, the use of conical shaped pens is known. French Patent No. 2 412 287 describes a makeup pen in the form of a cone, ending in a nib with two lips that define a small volume between them. According to the above patent, and French Patent Nos. 2 500 730 and 2 505 150, the pens include one or more transverse cavities that open into at least one capillary groove, by way of which the makeup product is distributed during the application; the cavity acts as a supply reservoir to the groove, and it fills when the pen is dipped into the reservoir.

SUMMARY OF THE INVENTION

According to the present invention, a pen is proposed with which more precise makeup can be obtained, and longer use of the makeup applicator without refilling is possible than with the conical pens used until now. This new pen has other advantages as well, which will be explained hereinafter.

Accordingly, the present invention relates to an assembly including a liquid reservoir and an applicator equipped with at least one flexible, elastically deformable pen, characterized in that the pen includes one part having the form of a truncated cone, extended at its end of the smaller cross section by a cylindrical part having this same smaller cross section. Preferably, the cross section of the frustoconical portion of the pen and that of the cylindrical portion are circular. Hence the flexibility of the pen is improved by comparison with the conical pens of the prior art; in fact, the pen no longer flexes in a conical portion but substantially in a cylindrical portion. Moreover, makeup can be applied with improved precision when a pen including a cylindrical portion is used. With a conical pen, when pressure is exerted on the pen in order to draw a line, the pen bends, and the thickness of the part in contact with the surface onto which the line is being traced increases; hence the thickness of the line varies considerably, depending on the pressure exerted on the pen. Contrarily, with the pen that includes a cylindrical portion, as in the present invention, it is the cylindrical portion that bends, which makes it possible to maintain a line of uniform size with greater precision. The length of the cylindrical portion is preferably at least 5% of the total length of the pen—that is, the total length of the conical portion and the cylindrical portion—and is at most 20% of this total length. More particularly, this length is between 10 and 15%.

In a preferred embodiment of the pen according to the present invention, the pen is flocked on its frustoconical portion and its terminal cylindrical portion. This flocking comprises the fixing of very short fibers on a surface, in particular by gluing. The flock used may, for instance, be composed of cotton, rayon, nylon or polyester fibers. The length of the fibers comprising the flock is preferably between 0.01 and 1.5 mm. Depending on the length of the fibers of the flock used, a variably smooth feel is obtained. Various capillary effects are also obtained, which makes it possible to adapt the pen to products of different viscosity by modifying the flock used. The flocking lends the pen an external capillary action, so that the quantity of product the pen can hold can be increased. The capillary action conferred by the flock is solely on the outside; this has the advantage of avoiding an ascent of the product in the applicator by internal capillary action, as happens for example for a brush, a felt-tip pen or the like.

Another advantage of the pen according to the invention, including a cylindrical end portion, is that it can be more easily flocked than the conical pens of the prior art. In fact, in the case of conical pens, a droplet tends to form at the end of the conical portion when glue is sprayed onto the pen, or when the pen is dipped in the glue; the result is that after applying the flock, the dimensions of the end used for makeup application vary highly imprecisely, with an attendant wide fluctuation in the performance of the flocked pens, unless considerable precautions are taken, which greatly increase the production cost. Contrarily, for the pen according to the invention, having a cylindrical end portion, this droplet effect does not arise except at the junction of the cone and the cylinder. Thus flocked pens having ends of much more precise dimensions can be obtained without increasing the production cost, because there is no risk that a drop of glue of uncontrolled size will solidify there.

In a preferred embodiment of the invention, the pen includes at least one transverse cavity in its frustoconical portion, and at least one capillary groove that extends solely over this frustoconical portion, beginning at the cavity, in the direction of the end of the pen.

Each cavity is preferably a hole pierced diametrically in the frustoconical portion of the pen and opening out on either side. The capillary grooves are preferably disposed longitudinally, along a directrix of the frustoconical portion of the pen. The grooves preferably become thinner toward the portion of the smaller cross section of the truncated cone.

The pens are provided with an applicator fixation device. This fixation device is most often a tang, which is inserted in a corresponding device of the applicator; it may also be receptacle in which a corresponding device of the applicator is inserted. In the present invention, it is preferable that the tang not be flocked; the tang of the pen can then remain sealed even if the end of the pen is flocked.

The following detailed, purely illustrative and non-limiting description will enable better comprehension of the invention, in conjunction with the accompanying drawings.

DESCRIPTION OF THE PREFERRED EMBODIMENT

Figure 1:
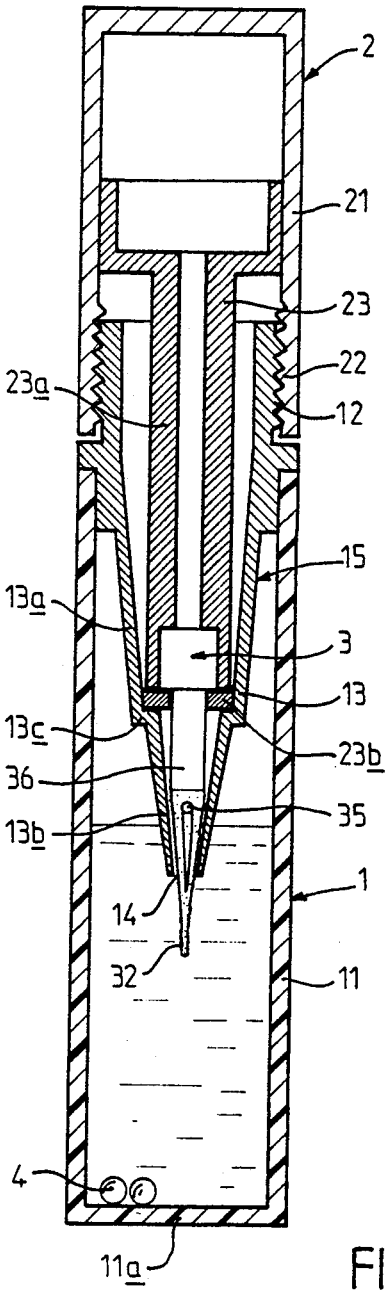
FIG. 1 is a longitudinal axial section showing an assembly for applying eyeliner, including a pen according to the present invention.

The assembly shown in FIG. 1 includes a reservoir 1 and an applicator 2 equipped with a pen 3.

Figure 3:
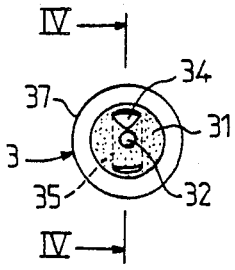
FIG. 3 is an end view of the pen of FIG. 2, taken along the line III—III of FIG. 2.
Figure 2:
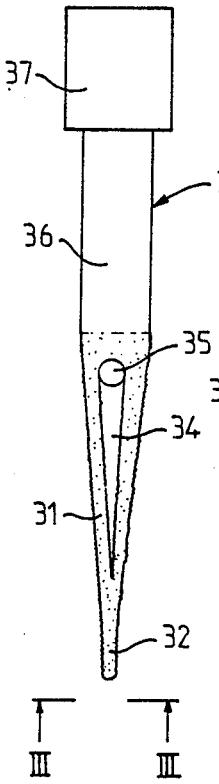
FIG. 2 is an elevation view on a larger scale of the pen of the assembly of FIG. 1.
Figure 4:
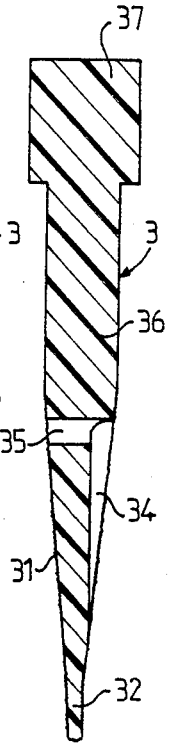
FIG. 4 is a section taken along the line IV—IV of FIG. 3.

The pen 3 is shown in greater detail in FIGS. 2–4. This pen 3 includes one portion that is a truncated cone of revolution 31, extended in its portion of smaller diameter by a cylindrical end portion 32, also a body of revolution. This cylindrical portion has a diameter of 0.4 mm and a length of 1.7 mm, for a pen 3 of which the frustoconical portion has a length of 9.3 mm. On the side of the frustoconical portion 31 opposite the cylindrical portion 32, a cavity 35 is pierced diametrically and transversely from one side through to the other of the frustoconical portion 31; the axis of the hole is located 0.9 mm away from the larger end of the frustoconical portion 31, and the hole has a diameter of 0.8 mm. A capillary groove 34 is made in this frustoconical portion 31, extending from the cavity 35 to the cylindrical portion of the pen 32. This groove 34 becomes thinner (in width and depth) from the cavity 35 toward the cylindrical portion 32. The cavity 35 opens out into the bottom of the groove 34 at its deepest portion. The pen 3 includes a tang, comprising a first cylindrical portion 36 having the same diameter as the edge of larger diameter of the frustoconical portion 31, that is, 2.2 mm, and having a length of 7 mm, and a second cylindrical portion 37 having a diameter of 3.3 mm over a length of 4 mm. The pen 3 is flocked solely on the frustoconical and cylindrical portions 31 and 32, while the tang (36, 37) has not been flocked. The tang (36, 37) can thus maintain tightness and can prevent any ascent of the product into the applicator, and consequently any loss of product.

The assembly including the pen according to the invention is generally in the shape of a fountain pen, in the exemplary embodiment shown; the reservoir 1 comprises a first portion of the fountain pen, and the applicator 2 a second portion. The applicator 2 includes a cap 21 that can be screwed by an internal thread 22 over a screw thread 12 made on one of the ends of the reservoir 1.

The reservoir 1 comprises two portions, a sheath 15 that carries the screw thread 12, and a tubular portion 11 provided with a bottom 11*a*. The sheath 15 includes a sleeve 13 inserted into the tubular portion 11 and oriented toward the bottom 11*a*; the sleeve 13 includes an opening 14, facing the bottom lla. This sleeve 13 comprises two frustoconical portions 13*a* and 13*b*, separated by a shoulder 13*c*. The pen is carried by a fixation device 23 firmly attached to the cap 21, for example by soldering or gluing; the fixation device 23 includes a tubular portion 23*a*, having an outside diameter slightly greater than that of the cylindrical portion 37 of the tang of the pen. At the free end of the tubular portion 23*a* is a recess having the dimensions of the cylindrical portion 37 of the tang of the pen; this portion 37 is retained in the recess by a washer 23*b* that is pressed against the end of the tubular portion 23a. The washer 23*b* may be fixed by gluing. When the applicator 2 is screwed onto the reservoir 1, the washer 23*b* is supported on the shoulder 13*c*, and the pen 3 is located in the frustoconical portion 13*b* of the sleeve 13, with the end of the pen projecting into the reservoir in the direction of the bottom 11*a*.

In the exemplary embodiment shown, balls 4 for stirring the liquid to be distributed are placed in the reservoir containing the liquid.

The device functions as follows: The user picks up the assembly, separates the applicator 2 from the reservoir 1 by unscrewing the cap 21, and then the pen 3 emerges from the reservoir 1 and from the sleeve 13. The cylindrical portion 32 of the pen 3, which has been dipped into the liquid contained in the reservoir, passes through the opening 14 of the sleeve 13 without losing any product by being squeezed out, because its diameter is so small. The quantity of product held on the pen is thus increased, and consequently the length of tim the makeup applicator can be used without refilling is increased as well. A certain quantity of liquid product is retained on the pen both because of the cavity 35 and by external capillary action because of the flocking. When the user draws the line of eyeliner on the eyelid, the liquid flows little by little by capillary action to the end of the cylindrical portion 32 of the pen 3. When the pen 3 is empty, the user dips it back into the reservoir, in order to fill the pen with a new quantity of liquid. When the user is finished, the user screws the applicator 2 back onto the reservoir 1.

What is claimed is:

1. An assembly comprising a reservoir for containing a liquid and an applicator equipped with at least one flexible, elastically deformable pen, wherein the pen has a frustoconical portion having an end of smaller cross section and which is elongated at its end of smaller cross section by a cylindrical portion having this same smaller cross section as said end of said frustoconical portion.

2. The assembly of claim 1, wherein the cross sections of the frustoconical and cylindrical portions of the pen are circular.

3. The assembly of claim 1, wherein the length of the cylindrical portion of the pen is between 5 and 20% of the total length of the frustoconical portion and cylindrical portion of the pen.

4. The assembly of claim 3, wherein the length of the cylindrical end portion of the pen is between 10 and 15% of the total length of the frustoconical portion and cylindrical portion of the pen.

5. The assembly of claim 1, wherein the pen is flocked on the frustoconical portion and the cylindrical portion.

6. The assembly of claim 5, wherein the length of the fibers comprising the flock is between 0.01 and 1.5 mm.

7. The assembly of claim 1, wherein the pen includes at least one transverse cavity and at least one capillary groove, which extends solely over the frustoconical portion, beginning at said cavity and extending in the direction of the end of the pen.

8. The assembly of claim 7, wherein each cavity is a hole pierced diametrically in the frustoconical portion of the pen and opening out on both sides.

9. The assembly of claim 7, wherein each capillary groove is made along a directrix of the frustoconical portion of the pen.

10. The assembly of claim 7, wherein the width and the depth of each capillary groove decreases progressively from the cavity to a vanishing point at the end of the groove adjacent the cylindrical portion of the pen.

11. The assembly of claim 7, wherein the pen includes a single cavity and a single groove.

12. A cosmetic pen comprising:

a frustoconical portion having a first cross-section at a first end and a second cross-section at a second end, the first cross-section having a diameter greater than the second cross-section;

a cylindrical portion, adjacent to the second end of said frustoconical portion, having a cross-section equivalent to the second cross-section of said frustoconical portion;

at least one transverse cavity pierced diametrically through said frustoconical portion near the first end of said frustoconical portion; and at least one capillary extending from said at least one transverse cavity along a directrix of said frustoconical portion, and ending near the second end of said frustoconical portion.

13. The cosmetic pen of claim 12, wherein said frustoconical portion and said cylindrical portion are flocked.

14. An assembly comprising a reservoir containing a liquid and an applicator equipped with at least one flexible, elastically deformable pen, wherein the pen has a frustoconical portion, elongated at its end of smaller cross section by a cylindrical portion having this same smaller cross section, wherein the length of the cylindrical portion of the pen is between 5 and 20% of the total length of the frustoconical portion and cylindrical portion of the pen.

* * * * *